US006233412B1

(12) United States Patent
Takahashi et al.

(10) Patent No.: US 6,233,412 B1
(45) Date of Patent: May 15, 2001

(54) FIXING DEVICE FOR DUAL-SIDED-PRINTING CAPABLE IMAGE REPRODUCING APPARATUS

(75) Inventors: Satoshi Takahashi; Toshimasa Takahashi; Satoshi Sato; Eiichiro Morisaki; Masamitsu Yamane, all of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/579,514

(22) Filed: May 26, 2000

(30) Foreign Application Priority Data

May 28, 1999 (JP) ..... 11-150339

(51) Int. Cl.[7] ..... G03G 15/20; G03G 15/00
(52) U.S. Cl. ..... 399/69; 399/43; 399/401
(58) Field of Search ..... 399/43, 45, 67, 399/69, 401, 364, 374; 219/216

(56) References Cited

U.S. PATENT DOCUMENTS 5,742,870 * 4/1998 Hwang ..... 399/69

FOREIGN PATENT DOCUMENTS 6-125974 * 11/1986 (JP) .
3-91746 * 4/1991 (JP) .
4-9973 * 1/1992 (JP) .
4-139479 * 5/1992 (JP) .
7-199720 * 8/1995 (JP) .
8-63037 * 3/1996 (JP) .

* cited by examiner

*Primary Examiner*—Susan S. Y. Lee
(74) *Attorney, Agent, or Firm*—Shinjyu Intellectual Property Firm

(57) ABSTRACT

In an electrophotographic printing apparatus, a fixing device heat-roller control system configured for specially controlling the heat roller fixing temperature during consecutive dual-sided copying of a large number of sheets. The electrophotographic printing apparatus in particular is adapted for stack-less conveyance from the fixing unit of sheets onto one side of which the copy toner image has been fixed in dual-sided copying, switching the sheets back to image reproduction unit. The fixing unit has a heat roller incorporating an internal heater and a press roller in pressing contact with the heat roller. The fixing device heat-roller control system includes a sensor associated with the heat roller for detecting its superficial temperature, a switching element for supplying/cutting off voltage to the internal heater, and a temperature control unit connected to the sensor and the switching element. Based on detection output from the sensor, the temperature control unit controls the switching element to maintain target heating temperatures in the heat roller, such that in consecutive dual-sided printing a number of sheets, for every multiple of a predetermined printing sheet count, the target heating temperature in the heat roller lowers in predetermined stages to a predetermined temperature, below an initial target heating temperature for toner-image fixing sheets in single-sided printing.

11 Claims, 2 Drawing Sheets

FIXING DEVICE FOR DUAL-SIDED-PRINTING CAPABLE IMAGE REPRODUCING APPARATUS

BACKGROUND OF THE INVENTION

1. Technical Field

The present invention relates to fixing devices; in particular, it relates to fixing devices in image reproducing apparatus employing electrophotographic technology, such as photocopiers, laser printers and fax machines.

2. Description of Related Art

A conventional image reproducing apparatus capable of dual-sided printing will be explained using FIG. 1. Sheets are taken out one at a time from a feeder cassette 1 by a sheet-feeding roller 11. After a sheet passes through a transport path 21, its leading edge is aligned at the registration unit 22 and the sheet awaits further processing. The sheet is then transported to an image reproduction unit 4 at a predetermined timing. At the image reproduction unit 4, a toner image is formed on a photosensitive drum 41, and this toner image is transferred to a first surface of the sheet by a transfer apparatus 45. The sheet with an unfixed toner image transferred onto one surface passes through a transport path 24 and is transported to a nipping region between a heating roller 51 and a pressure roller 52, which constitute a fixing device 5. In this fixing device 5, the two rollers grip and heat the sheet. The unfixed toner image formed on the first side of the sheet is thereby fixed.

Next, the sheet having an image on the first side is sent to an upstream-end transport path 25 by means of a branching claw 6, and passes through the upstream-end transport path 25 to be passed to a switchback mechanism 7. Within the switchback mechanism 7, the transport direction of the sheet is changed and it is passed to a downstream transport path 26. Next the sheet having an image on the first side passes through the downstream transport path 26, a lower transport path 27, and a vertical transport path 28 and is again sent to the registration unit 22. There the front edge of the sheet is aligned, and the sheet awaits further processing. The sheet is then transported to the image reproduction unit 4 at a predetermined timing. At the image reproduction unit 4, a toner image formed on the photosensitive drum 41 is transferred to a second side of the sheet by the transfer apparatus 45. The sheet with an unfixed toner image transferred onto its second side is transported to the nipping region between the heating roller 51 and pressure roller 52, and the two rollers grip and heat the sheet. By this means, the unfixed toner image formed on the second side of the sheet is fixed. The sheet with images thus printed on both sides is sent to a paper discharge unit 29 by the branching claw 6, and is discharged to a paper discharge tray 9.

In an apparatus using the conventional technology as described above, the fixing process causes a sheet with an image formed on its first side to reach a high temperature. This sheet is immediately transported again to the image reproduction unit 4 while still hot in order to form an image on the second side. When the sheet makes contact with the photosensitive drum 41, heat from the sheet is transmitted to the photosensitive drum 41, and the temperature of the photosensitive drum 41 rises gradually. For example, if dual-sided printing is performed continuously for 100 sheets, the surface temperature of the photosensitive drum 41 rises to approximately 60° C. If the temperature of the photosensitive drum 41 rises to approximately 60° C., then the surface potential in the development regions of the photosensitive drum 41 decreases, and toner used by the image reproduction unit 4 begins to clump on the surface of the photosensitive drum 41, resulting in inferior images. Also, due to the influence of the heat of the photosensitive drum 41, the cleaning performance of the cleaning unit declines, or otherwise various out-of-order situations arise.

Table 1 sets forth sheet temperature and local temperatures in this sort of conventional image reproduction apparatus when continuous dual-sided printing is carried out.

Conditions for this Identification Test 1 are as follows.

Room temperature/humidity: 28° C./50%

Conveyance speed: 350 mm/sec, 40 sheets/min (A4 size , lateral through)

Photo sensitive drum diameter: 60 mm

Photosensitive drum heater temperature: 45° C. (controlled to turn off at or above 45° C.)

Heating roller: One wherein upon printing 100 consecutive sheets without putting the heater on, an approximately 40° C. heating roller temperature drop from 180° C. is evident.

Heating roller temperature: 180±5° C. (turned on at or below 175° C., off at or above 185° C.)

How paper passed: Dual-sided printing every six sheets in turn; regular A4-size sheets, sideways sheet-passing.

(In the tables in the present specification, "⊙" indicates "satisfactory," while "Δ" indicates "poor.")

TABLE 1

CONSECUTIVE DUAL-SIDED PRINTING TEST ACCORDING TO CONVENTIONAL TECHNOLOGY 1

| | Number of sheets | | | | | | | |
|---|---|---|---|---|---|---|---|---|
| Measurement Item | 1 | 12 | 36 | 48 | 72 | 102 | 150 | 198 |
| Sheet Temperature (° C.) | 60 | 60 | 60 | 60 | 60 | 60 | 60 | 60 |
| Photosensitive Drum Temperature (° C.) | 45 | 47 | 50 | 54 | 55 | 58 | 60 | 58 |
| Fixing Performance (Subjective Evaluation) | ⊙ | ⊙ | ⊙ | ⊙ | ⊙ | ⊙ | ⊙ | ⊙ |
| Notes | — | — | — | — | — | *1 | *1 | *1 *2 |

*1: image fogging occurred
*2: offset image (cleaning defects)

As is clear from Table 1, upon continuous printing of two sides of approximately 100 sheets, the surface temperature of the photosensitive drum rises to approximately 60° C., and thereafter remains near 60° C. The fault noted in *1 is thought to be image fogging due to reduction of the surface potential in development regions.

The cause of the fault noted in *2 is thought to arise because the photosensitive drum temperature rises to approximately 60° C., so that the surface toner temperature approaches the glass transition temperature, causing toner to adhere more readily to the photosensitive drum surface.

Fixing performance was evaluated by rubbing with the hand to determine whether the fixed toner image comes off or not. Here fixing posed no problems in particular.

In order to resolve the aforementioned problems, generally, dual-sided printing is performed at a temperature set lower than the temperature set for fixing during printing onto a single side only. The use of this kind of technology resolves the aforementioned problems in many image reproduction devices. Nonetheless, it has been realized that wherein conditions that were employed in the current experiments—such as no intermediate tray being provided (stack-less); temperature characteristics in the photosensitive drum being severe (the drop in surface potential due to temperature elevation is large); glass transition temperature of the toner being low; and printing sheet count being large—overlap, then out-of-order situations arise even according to the foregoing technology. Table 2 sets forth the sheet temperature and the temperatures at different locations during continuous dual-sided printing in an image reproducing device based on the conventional technology described above. The conditions for these confirmation experiments 2 are as follows.

Room temperature/humidity: 28° C./50%

Transport speed: 350 mm/sec, 40 sheets/min (A4 size, lateral through)

Photosensitive drum diameter: 60 mm

Photosensitive drum heater temperature: 45° C. (controlled to turn off at or above 45° C.)

Heating roller: One wherein upon printing 100 consecutive sheets without putting the heater on, an approximately 40° C. heating roller temperature drop from 180° C. is evident.

Heating roller temperature: 160±5° C. (turned on at or below 155° C., off at or above 175° C.)

How paper passed: Dual-sided printing every six sheets in turn; regular A4-size sheets, sideways sheet-passing.

TABLE 2

CONSECUTIVE DUAL-SIDED PRINTING TEST ACCORDING TO CONVENTIONAL TECHNOLOGY 2

| | Number of sheets | | | | | | | |
|---|---|---|---|---|---|---|---|---|
| Measurement Item | 1 | 12 | 36 | 48 | 72 | 102 | 150 | 198 |
| Sheet Temperature (° C.) | 60 | 60 | 60 | 60 | 60 | 60 | 60 | 60 |
| Photosensitive Drum Temperature (° C.) | 45 | 47 | 50 | 50 | 49 | 50 | 52 | 52 |
| Fixing Performance (Subjective Evaluation) | Δ | Δ | ⊙ | ⊙ | ⊙ | ⊙ | ⊙ | ⊙ |
| Notes | — | — | — | — | — | — | — | — |

As is clear from Table 2, upon continuous printing of two sides of approximately 50 sheets, the surface temperature of the photosensitive drum rises to approximately 50° C., and thereafter remains near 50° C. The increase in temperature of the photosensitive drum is suppressed considerably, and the image fogging, cleaning failure and other faults occurring in the confirmation experiments 1 are resolved.

However, it was confirmed that fixing is poor on the initial several sheets. The cause is thought to be that with the photosensitive drum and transport paths of the image reproducing apparatus in a cooled state, the fixing temperature is set low, resulting in poor fixing.

It may be possible to resolve this second problem by, for example, setting the temperature setting slightly higher during dual-sided printing; but it would be dangerous to raise the temperature above the existing range.

SUMMARY OF THE INVENTION

An object of the present invention is to ensure toner image fixity onto sheets in dual-sided printing in electrophotographic image reproducing apparatuses by preventing image fogging, cleaning defects and like faults.

Another object of the invention is to enable clear toner image fixity onto dual-sided printing sheets even under image reproducing apparatus conditions including: stackless switchback sheet conveyance, harsh photosensitive drum temperature characteristics leading to drop in drum surface potential, low glass transition temperature of toner employed, and large dual-sided printing sheet counts.

The fixing device of this invention is provided in an image reproducing apparatus capable of dual-sided printing. It is a device for fixing toner images transferred onto both sides of a sheet, and comprises a fixing transport mechanism and heating control means. The fixing transport mechanism applies heat and pressure while transporting a sheet onto which a toner image has been transferred. During continuous dual-sided printing of multiple sheets, the heating control means causes incremental changes in the target heating temperature, starting from a first temperature, each time a predetermined number of sheets is printed.

When printing onto an initial number of sheets during dual-sided printing, the target heating temperature for fixing is set at, for example, a temperature equal to that when printing onto a single side. This ensures proper fixing performance. In the course of printing continuously onto both sides, the target heating temperature is gradually made to approach a target temperature for dual-sided printing, which is lower than the target temperature for single-sided printing; thus the problem of the rise in temperature of the photosensitive drum can be resolved.

In this device, it is preferable that the heating control means maintain the target temperature at a second temperature when the number of sheets printed reaches a predetermined number.

In this device, when the image reproducing apparatus is ready to perform single-sided printing, it is preferable that the heating control means set the target heating temperature for single-sided printing at a third temperature, said third temperature being higher than the second temperature.

In this device, it is preferable that the third temperature be the same as the first temperature.

In this device, it is preferable that the fixing transport mechanism have a heating roller with an internal heater, as well as a pressure roller that presses against the heating roller.

In this device, it is preferable that heating control means have a sensor for detecting the surface temperature of the heating roller, a switching element to supply or to cut off the supply of power to the heater, and a control unit to control the switching member based on the detection output of the sensor.

In this device, it is preferable that the heating control means exercise control such that the temperature is lowered in increments, each increment being the same per sheet count.

From the following detailed description in conjunction with the accompanying drawings, the foregoing and other objects, features, aspects and advantages of the present invention will become readily apparent to those skilled in the art.

DETAILED DESCRIPTION OF THE PREFERRED EMBODIMENTS

Figure 1:
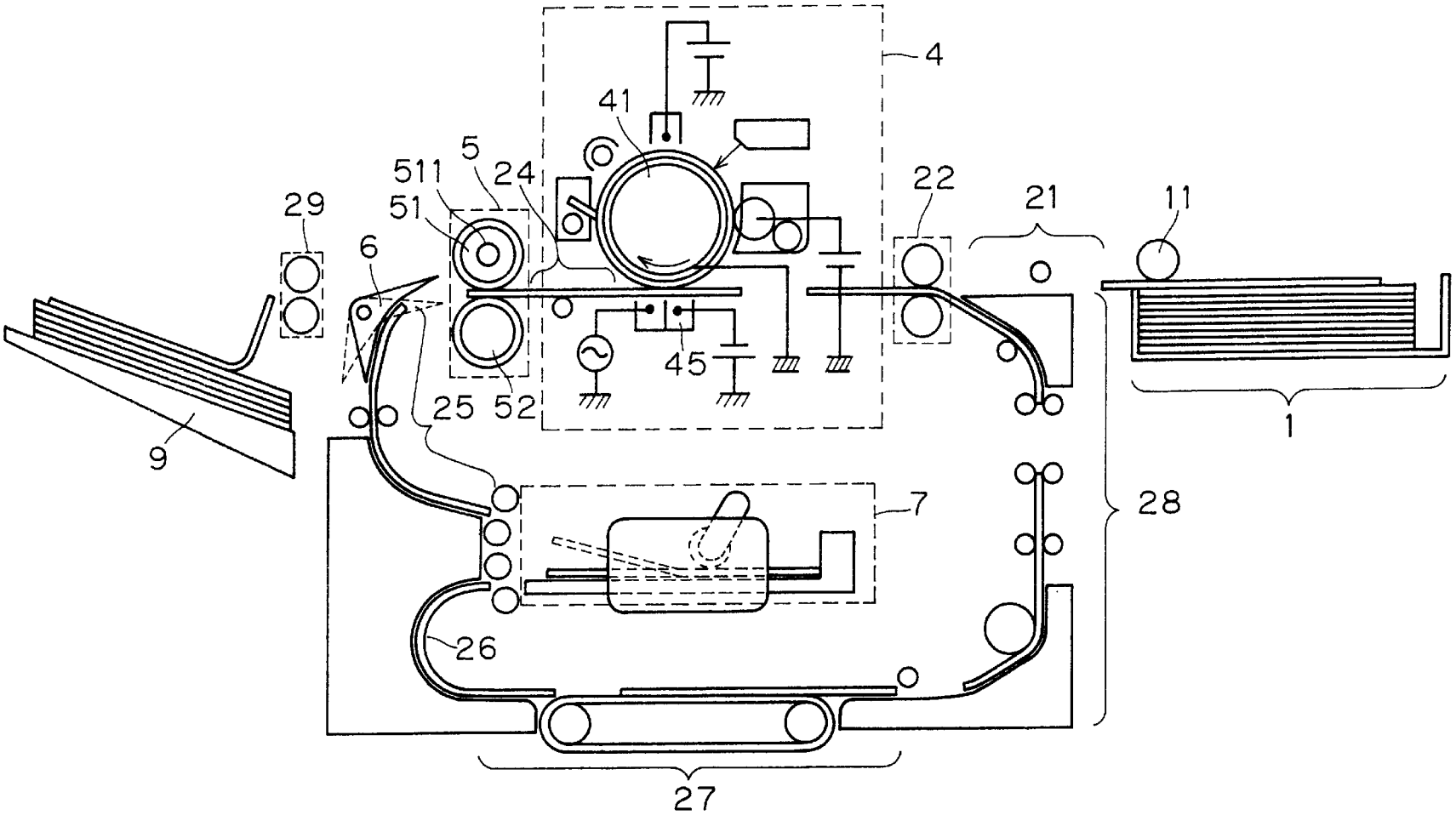
FIG. 1 is a schematic view of a stack-less image reproducing apparatus capable of dual-sided printing, both of the conventional technology and of the present invention.

FIG. 1 will be used to explain the operations of an image reproducing apparatus capable of dual-sided printing that embodies one aspect of this invention.

Sheets are taken out one at a time from a feeder cassette 1 by a sheet-feeding roller 11. After a sheet passes through a transport path 21, its front edge is aligned at a registration unit 22, where the sheet stands by. The sheet is then transported to an image reproduction unit 4 at a predetermined timing. At the image reproduction unit 4, a toner image is formed on the photosensitive drum 41, and this toner image is transferred onto a first side of the sheet by a transfer apparatus 45. The sheet with an unfixed toner image transferred onto one surface passes through a transport path 24 and is transported to the nipping region between a heating roller 51 and a pressure roller 52, which constitute a fixing device 5. In this fixing device 5, the two rollers grip and heat the sheet. The unfixed toner image formed on the first side of the sheet is thereby fixed.

Next, the sheet having an image on the first side is sent to an upstream-side transport path 25 by means of a branching claw 6, and passes through the upstream-side transport path 25 to be passed to a switchback mechanism 7. Within the switchback mechanism 7, the transport direction of the sheet is changed and it is passed to a downstream transport path 26. At this point, the sheet is guided within the switchback mechanism 7 to a predetermined position along its width by a guide member. Next the sheet having an image on the first side is transported from the downstream transport path 26 to the lower transport path 27. In the lower transport path 27, a guide member guides the sheet along its width as it is transported. After passing through a vertical transport path 28, it is again sent to the registration unit 22, where the front edge is aligned and the sheet stands by. The sheet is then transported to the image reproduction unit 4 at a predetermined timing, and in the image reproduction unit 4, a toner image formed on the photosensitive drum 41 is transferred to a second side of the sheet by the transfer apparatus 45. The sheet with an unfixed toner image transferred to its second side passes through the transport path 24 and is transported to the nipping region between the heating roller 51 and pressure roller 52, and the two rollers grip and heat the sheet. The unfixed toner image formed on the second side of the sheet is thereby fixed. The sheet with images thus printed on both sides is sent to the paper discharge unit 29 by the branching claw 6, and is expelled into the paper discharge tray 9.

Figure 2:
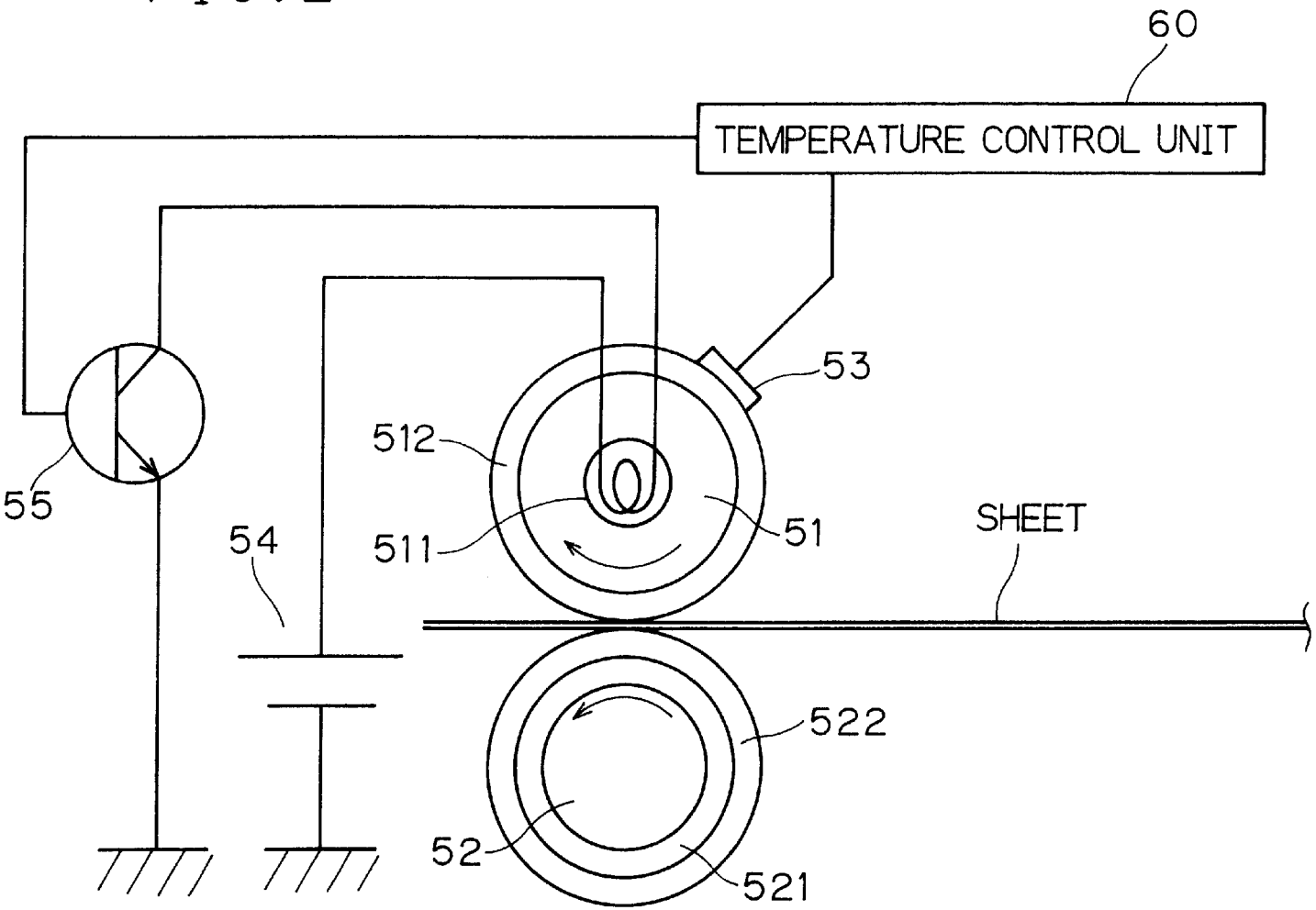
FIG. 2 is a schematic view of the fixing means of the present invention.

Next the fixing device 25 will be explained in detail, referring to FIG. 2.

The fixing device 25 has a heating roller 51, a pressure roller 52 that presses against the heating roller 51, a temperature detection sensor 53 for detecting the surface temperature of the heating roller 51, a switching element 55, and a temperature control unit 60.

The heating roller 51 has an internal heater 511, which may be a halogen lamp, and a base material 512 of aluminum or other material with superior thermal conductivity. A power supply 54 supplies power to the heater 511. The pressure roller 52 is formed by covering the outer periphery of a roller 521 of aluminum or the like of good heat-conductivity with an elastic layer 522 made of heat-resistant urethane rubber, and forming on the periphery thereof a parting-type layer of PTFE or other fluoride resin. The switching element 55 turns the supply of power to the heater on and off. The temperature control unit 60 controls the switching element 55 on the basis of information from the temperature detection sensor 53. Information on operation mode (whether single-sided or dual-sided printing), information on number of sheets to be printed, and other like information is input to the temperature control unit 60.

Next, the control operation of the temperature control unit 60 will be explained.

During printing onto one side of the sheet only, and in the routine stable state on standby, in which printing can be executed immediately on receipt of a print instruction, the fixing temperature (control target temperature) as controlled by the temperature control unit 60 is set at 180° C., with threshold control exercised at 180±5° C. More specifically, when the surface temperature of the heating roller 51 as converted from the detection signal from the temperature detection sensor 53 falls below the first fixing threshold (in this case, 175° C.), the switching element is turned on, and power is supplied to the heater 511. The temperature of the heating roller 51 thereby rises. Conversely, when the surface temperature of the heating roller 51 detected by the temperature detection sensor 53 rises above the second fixing threshold (in this case, 185° C.), the switching element is turned off, and the supply of power to the heater 511 is stopped. As a result, the heating roller 51 surrenders heat as sheets and air come in contact therewith, and the temperature falls. The first and second threshold values are determined by the control temperature.

When printing on both sides, temperature control is exercised using the fixing temperature control table shown in FIG. 3 below. In other words, the control target temperature is lowered by 2° C. for each ten sheets printed.

TABLE 3

FIXING TEMPERATURE CONTROL TABLE FOR PRESENT INVENTION

| Printing Sheet Count | 1–10 | 11–20 | 21–30 | 31–40 | 41 –50 | 51–60 | 61–70 | 71–80 | 81–90 | 91–100 | ≧100 |
|---|---|---|---|---|---|---|---|---|---|---|---|
| Control Target Temp. (° C.) | 180 | 178 | 176 | 174 | 172 | 170 | 168 | 166 | 164 | 162 | 160 |

The sheet temperature and local temperatures during continuous dual-sided printing in this embodiment are shown in Table 4. Confirmation tests 3 were performed under the following conditions.

Room temperature/relative humidity: 28° C./50%

Transport speed: 350 mm/sec, 40 sheets/min (A4 size, lateral through)

Photosensitive drum diameter: 60 mm

Photosensitive drum heater temperature: 45° C. (controlled to turn off at or above 45° C.)

Heating roller: One wherein upon printing 100 consecutive sheets without putting the heater on, an approximately 40° C. heating roller temperature drop from 180° C. is evident.

Heating roller temperature: threshold control based on Table 3

How paper passed: Dual-sided printing every six sheets in turn; regular A4-size sheets, sideways sheet-passing.

TABLE 4

CONSECUTIVE DUAL-SIDED PRINTING TEST ACCORDING TO AN EMBODIMENT OF THE PRESENT INVENTION

| Measurement Item | Number of sheets | | | | | | | |
|---|---|---|---|---|---|---|---|---|
| | 1 | 12 | 36 | 48 | 72 | 102 | 150 | 198 |
| Sheet Temperature (° C.) | 60 | 60 | 60 | 60 | 60 | 60 | 60 | 60 |
| Photosensitive Drum Temperature (° C.) | 45 | 46 | 49 | 52 | 52 | 50 | 52 | 52 |
| Fixing Performance (Subjective Evaluation) | ⊙ | ⊙ | ⊙ | ⊙ | ⊙ | ⊙ | ⊙ | ⊙ |
| Notes | — | — | — | — | — | — | — | — |

As is unquestionable from the results of Table 4, it will be understood that clear fixity meanwhile suppressing temperature elevation in the photosensitive drum is possible.

Application of the present invention suppresses elevation in the temperature of the photosensitive drum peculiar to a stack-less image reproducing apparatus capable of dual-sided printing, to meanwhile realize secure fixing performance.

While only selected embodiments have been chosen to illustrate the present invention, to those skilled in the art it will be apparent from this disclosure that various changes and modifications can be made herein without departing from the scope of the invention as defined in the appended claims. Furthermore, the foregoing description of the embodiments according to the present invention is provided for illustration only, and not for the purpose of limiting the invention as defined by the appended claims and their equivalents.

What is claimed is:

1. A fixing device provided in an image reproducing apparatus capable of dual-sided printing on sheets, for fixing toner images transferred onto either side of the sheets, the fixing device comprising:

a fixing conveyance mechanism for heating, pressing and meanwhile conveying sheets onto which toner images have been transferred;

heating control means for causing, when dual-sided printing a plurality of sheets consecutively, target temperature for the heating to make a transition from a first temperature in stages with every printing of a predetermined sheet count.

2. The fixing device set forth in claim 1, wherein said heating control means maintains the target temperature for heating at a second temperature if the printing sheet count is the predetermined sheet count or more.

3. The fixing device set forth in claim 2, said image reproducing apparatus being capable of single-sided printing onto sheets, wherein said heating control means sets the target temperature for heating a third temperature higher than said second temperature during single-sided printing.

4. The fixing device set forth in claim 3, wherein said third temperature has the same value as said first temperature.

5. The fixing device set forth in claim 1, wherein said fixing conveyance mechanism includes a heat roller having an internal heater; and a press roller in pressure-contact with said heat roller.

6. The fixing device set forth in claim 5, wherein said heating control means includes:

a sensor for detecting superficial temperature of said heat roller;

a switching component for supplying/cutting off voltage to said heater; and a control unit for controlling said switching component based on detection output from said sensor.

7. The fixing device set forth in claim 1, wherein said heating control means controls temperature to lower in stages by the same for every same printing sheet count.

8. In an electrophotographic printing apparatus adapted for stack-less switchback conveyance in dual-sided copying of sheets to which toner images transferred from a photosensitive drum having temperature cutoff control are fixed by a fixing unit having a heat roller incorporating an internal heater and a press roller in pressing contact with the heat roller, a fixing device heat-roller control system comprising:

a sensor associated with the heat roller for detecting superficial temperature thereof;

a switching element for supplying/cutting off voltage to the internal heater; and a temperature control unit connected to the sensor and the switching element and based on detection output from the sensor, for controlling the switching element to maintain target heating temperatures in the heat roller, the temperature control unit being configured such that in consecutive dual-sided printing a number of sheets that is a multiple of a predetermined printing sheet count:

the target heating temperature in the heat roller initially is a first predetermined temperature, for every multiple of the predetermined printing sheet count, the target heating temperature in the heat roller lowers in predetermined stages to a second predetermined temperature, and upon completion of consecutive dual-sided printing the number of sheets, the target heating temperature in the heat roller rises to a third predetermined temperature.

9. A fixing device heat-roller control system as set forth in claim 8, wherein the first predetermined temperature is for toner-image fixing sheets in single-sided printing.

10. A fixing device heat-roller control system as set forth in claim 8, wherein the third predetermined temperature is equal to the first predetermined temperature.

11. A fixing device heat-roller control system as set forth in claim 8, wherein the predetermined stages by which the target heating temperature in the heat roller lowers to the second predetermined temperature are of equal degree.

* * * * *